US010072670B2

(12) United States Patent
Jung et al.

(10) Patent No.: US 10,072,670 B2
(45) Date of Patent: Sep. 11, 2018

(54) FAN SHROUD ASSEMBLY

(71) Applicant: Hanon Systems, Daejeon (KR)

(72) Inventors: Woo Youl Jung, Daejeon (KR); Cha You Lim, Daejeon (KR); Yong Sung Kwon, Daejeon (KR); Kyung Seok Cho, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 222 days.

(21) Appl. No.: 14/899,816

(22) PCT Filed: Jun. 19, 2014

(86) PCT No.: PCT/KR2014/005401
§ 371 (c)(1),
(2) Date: Dec. 18, 2015

(87) PCT Pub. No.: WO2014/204224
PCT Pub. Date: Dec. 24, 2014

(65) Prior Publication Data

US 2016/0138610 A1 May 19, 2016

(30) Foreign Application Priority Data

Jun. 19, 2013 (KR) ..... 10-2013-0070112
Jun. 17, 2014 (KR) ..... 10-2014-0073420

(51) Int. Cl.
*F04D 29/52* (2006.01)
*F04D 29/16* (2006.01)
(Continued)

(52) U.S. Cl.
CPC ..... *F04D 29/52* (2013.01); *F01P 5/06* (2013.01); *F01P 11/12* (2013.01); *F04D 19/002* (2013.01);
(Continued)

(58) Field of Classification Search
CPC .... F04D 29/164; F04D 29/526; F04D 29/663; F04D 19/002; F04D 25/08; F01P 11/12; F01P 5/06
See application file for complete search history.

(56) References Cited

U.S. PATENT DOCUMENTS 6,863,496 B2 * 3/2005 Cho ..... F04D 29/164 415/173.5
6,874,990 B2 * 4/2005 Nadeau ..... F04D 29/164 123/41.49
(Continued)

FOREIGN PATENT DOCUMENTS

CN 1441170 A 9/2003
JP 2009108782 A * 5/2009
(Continued)

*Primary Examiner* — Igor Kershteyn
*Assistant Examiner* — Brian P Wolcott
(74) *Attorney, Agent, or Firm* — Shumaker, Loop & Kendrick, LLP; James D. Miller

(57) ABSTRACT

Provided is a fan shroud assembly and, more specifically, a fan shroud assembly including a swirling airflow-preventing saw-teeth which is arranged along a predetermined inner circumferential surface of a ventilating part while maintaining a predetermined gap from an end portion of a blade of a fan or an end portion of a fan band of the fan and are formed in a saw-toothed shape, in which both a first area in which the swirling airflow-preventing saw-teeth are formed and a second area from which the swirling airflow-preventing saw-teeth are removed are formed, thereby generating a swirling airflow of ventilated air due to a reduction in pressure fluctuation and thus effectively reducing noise.

13 Claims, 11 Drawing Sheets

(51) Int. Cl.

| | |
|---|---|
| ***F04D 29/66*** | (2006.01) |
| ***F04D 19/00*** | (2006.01) |
| ***F04D 25/08*** | (2006.01) |
| ***F01P 5/06*** | (2006.01) |
| ***F01P 11/12*** | (2006.01) |

(52) U.S. Cl.
CPC ..... *F04D 25/08* (2013.01); *F04D 29/164* (2013.01); *F04D 29/663* (2013.01)

(56) References Cited

U.S. PATENT DOCUMENTS

| | | | | |
|---|---|---|---|---|
| 7,481,615 | B2 * | 1/2009 | Park | F04D 29/164<br>123/41.49 |
| 2004/0156712 | A1 | 8/2004 | Nadeau | |

FOREIGN PATENT DOCUMENTS

| | | | |
|---|---|---|---|
| KR | 1020030070945 | A | 9/2003 |
| KR | 100822177 | B1 | 4/2008 |
| KR | 20080087463 | A | 10/2008 |

* cited by examiner

FAN SHROUD ASSEMBLY

CROSS-REFERENCE TO RELATED APPLICATIONS

This patent application is a United States national phase patent application based on PCT/KR2014/005401 filed Jun. 19, 2014 which claims the benefit of Korean Patent Application No. 10-2013-0070112 filed Jun. 19, 2013 and Korean Patent Application No. 10-2014-0073420 filed Jun. 17, 2014. The entire disclosures of the above patent applications are hereby incorporated herein by reference.

TECHNICAL FIELD

The following disclosure relates to a fan shroud assembly and, more specifically, to a fan shroud assembly including a swirling airflow-preventing saw-teeth which is arranged along a predetermined inner circumferential surface of a ventilating part while maintaining a predetermined gap from an end portion of a blade of a fan or an end portion of a fan band of the fan and is formed in a saw-toothed shape, in which both a first area in which the swirling airflow-preventing saw-teeth is formed and a second area from which the swirling airflow-preventing saw-teeth is removed are formed, thereby generating the swirling airflow of ventilated air due to a reduction in pressure fluctuation and thus effectively reducing noise.

BACKGROUND

An engine of a vehicle generating an actual driving force generates a large amount of heat energy during a process of converting chemical energy into kinetic energy. When heat energy is excessively generated, the engine and/or parts around the engine are overheated and are thus damaged or destroyed, which may lead to various problems such as big breakdowns and accidents and greatly reduce efficiency of the engine itself, etc. Therefore, to remove the problems, a vehicle is generally equipped with an apparatus for cooling the engine. A representative method used to cool the engine is a method for using cooling water and includes a radiator distributing cooling water to a circumference of the engine and cooling the cooling water to absorb heat generated from the engine and then emits the absorbed heat from the radiator, thereby preventing the engine from being overheated. Further, an apparatus for cooling the interior of room for comfort of a vehicle driver and passengers is also provided. A heat exchanger like a condenser for cooling a refrigerant of an air conditioner for cooling the interior of room has been used.

The heat exchangers such as the radiator and the condenser as described above are provided in front of an engine room of the vehicle and the heat exchangers exchange heat between air therearound and a heat exchange medium inside the heat exchanger. In this case, to increase heat radiation efficiency of the heat exchanger, an axial-flow fan that may forcibly ventilate air to the heat exchanger is provided.

The axial-flow fan is generally accommodated in a shroud, a motor, etc., for rotating the axial-flow fan is fixed to the shroud, and the shroud is mounted to fix its position. As such, an axial-flow fan assembly configured of the axial-flow fan, the shroud, the motor, etc., is mounted in the heat exchanger or a floor of the engine room to be disposed in front of or in back of the heat exchanger.

As illustrated in FIG. 1, an assembly of the fan shroud according to the related art is greatly configured of a fan 10 and a shroud 20. The fan 10 is configured to include a hub coupled with a rotating shaft of a motor 11, a plurality of blades 12 formed on an outer circumferential surface of the hub at a predetermined interval, and J-letter or hook-shaped bands connecting end portions of the blades 12.

The shroud 20 is formed along an outermost rotating trajectory of the blade 12 in a shape enclosing the blade 12 not to be in contact with the band and thus is adjacent to the heat exchanger (not illustrated).

An end portion of the shroud 20 corresponding to an opposite side adjacent to the heat exchanger is integrally formed with a bell mouth 21 curved at a constant curvature and the motor 11 of which the rotating shaft is coupled with the hub is fixedly mounted by a separate motor mounting part 22.

Further, the shroud 20 is provided with a plurality of stators 23 connecting an outer side surface of the motor mounting part 22 to an outer side surface of the bell mouth 21.

According to the related art configured as described above, as the blade 12 of the fan 10 rotates by receiving a driving force of the motor 11, air passing through the heat exchanger is forcibly sucked such that most air passes through the blade 12 as it is and the rest air flows to the bell mouth 21 along an inner side surface of the shroud 20, and the air flowing to the bell mouth 21 is discharged to an outside of the fan 10.

In this case, however, a portion adjacent to the bell mouth 21 is an end portion in which air delivered by the fan 10 flows and an air flow is suddenly changed at the portion of the bell mouth 21 to easily form a swirling airflow, thereby causing noises.

Korean Patent No. 0729650 (Registered on Jun. 12, 2007: Shroud Having Structure For Noise Reduction, hereinafter, referred to as Related Art Document) discloses a shroud having a structure for noise reduction in which a ventilating part into which an axial-flow fan is inserted is arranged with a swirling airflow-preventing saw-teeth inclined in a rotating direction of the axial-flow fan to suppress a swirling airflow and a recirculating airflow from occurring upon air ventilation due to a rotation of the axial-flow fan, thereby effectively reducing noises and ventilating air. As described in the Related Art Document, the shroud to which the swirling airflow-preventing saw-teeth is applied is illustrated in FIG. 2.

By the way, as illustrated in FIG. 2, in the fan shroud assembly for a vehicle, a shroud 20 does not generally have a symmetric shape and a portion where a space between the bell mouth 21 provided with the swirling airflow-preventing saw-teeth and an outer edge of the shroud is narrow due to space constraints when the shroud is equipped in the vehicle is formed in areas adjacent to upper ends and lower ends of the bell mouth and the ventilating part.

The change in flow pressure is rather increased at the portion due to the swirling airflow-preventing saw-teeth 24 formed to prevent noises, thereby increasing the occurrence of noises.

SUMMARY

An embodiment of the present invention is directed to providing a fan shroud assembly including a swirling airflow-preventing saw-teeth which is arranged along a predetermined inner circumferential surface of a ventilating part while maintaining a predetermined gap from an end portion of a blade of a fan or an end portion of a fan band of the fan and is formed in a saw-toothed shape, in which both a first area in which the swirling airflow-preventing saw-teeth is formed and a second area from which the swirling airflow-preventing saw-teeth is removed are formed, thereby generating the swirling airflow of ventilated air due to a reduction in pressure fluctuation and thus effectively reducing noise.

Another embodiment of the present invention is directed to providing a fan shroud assembly in which a swirling airflow-preventing saw-teeth suppresses a swirling airflow and a recirculating airflow from occurring when air is ventilated by a rotation of the fan to reduce noises and the swirling airflow-preventing saw-teeth is formed only in some area to prevent a change in flow pressure from rather increasing due to the swirling airflow-preventing saw-teeth positioned at a portion where a space between a bell mouth and an outer edge of the shroud is narrow, that is, at an area adjacent to a radius line in a vertical direction of a ventilating part.

Still another embodiment of the present invention is directed to providing a fan shroud assembly capable of preventing the fan from being stuck or being frozen due to moisture frozen between a fan band and a bell mouth of the shroud.

In one general aspect, a fan shroud assembly 1 includes: a fan 150 configured to include a hub 120 coupling with a rotating shaft of a motor 110, a plurality of blades 130 formed on an outer circumferential surface of the hub 120, and a fan band 140 connecting between the blades 130 at end portions of the blades 130; and a shroud 160 configured to include a plenum part 101, a bell mouth 200 forming a ventilating part 100 through which air is ventilated by a rotation of the fan, a motor mounting 300 fixed with the motor driving the fan, and a plurality of stators 400 connecting between the motor mounting 300 and the bell mouth 200 at a front side of the fan of a vehicle, the fan shroud assembly 1 includes: a swirling airflow-preventing saw-teeth 500 formed in a saw-toothed shape along a predetermined area of an inner circumferential surface of the ventilating part 100 and arranged to maintain a predetermined gap from an end of the fan band, in which end portions are spaced apart from each other in a circumferential direction of an area in which the swirling airflow-preventing saw-teeth 500 is formed.

The fan shroud assembly may be configured to include a first area A1 which is an area in which the swirling airflow-preventing saw-teeth 500 is formed and a second area A2 which is an area in which the inner circumferential surface of the ventilating part is formed flatly.

The second area A2 may be formed in an area in which a distance between an outer edge surface of the plenum part 101 and the bell mouth 200 is the shortest distance.

The second area A2 may be configured to include an area spaced as much as an angle θ in one direction from a radius line R1 extending in a radial direction from a central portion of the ventilating part 100 and an area spaced as much as an angle θ' in the other direction therefrom.

In the second area A2, the angles θ and θ' which are angles spaced at both sides in the circumferential direction from the radius line R1 may form an acute angle.

In the second area A2, the angles θ and θ' which are the angles spaced at both sides in the circumferential direction from the radius line R1 may be the same as each other.

In the second area A2, the angles θ and θ' which are angles spaced at both sides in the circumferential direction from the radius line R1 may be different from each other.

In the second area A2, the angles θ and θ' which are angles spaced at both sides in the circumferential direction from the radius line R1 may range from 15 to 20°.

The radius line R1 may be a vertical line to a tangent line of a point where a distance between an outer edge surface of the plenum part 101 and the bell mouth 200 is the shortest distance.

The radius line R1 may coincide with a radial line extending in a vertical direction from the central portion of the ventilating part 100.

In the shroud 160, the plenum part 101 may be formed in a rectangle or a square.

The radius line R1 may be in a state in which the radial line extending in the vertical direction from the central portion of the ventilating part 100 rotates by a predetermined angle.

The second area A2 may be an area positioned at a lower part in a gravity direction.

Other features and aspects will be apparent from the following detailed description, the drawings, and the claims.

DETAILED DESCRIPTION OF EMBODIMENTS

Hereinafter, as described above, a fan shroud assembly according to exemplary embodiments of the present invention will be described in detail with reference to the accompanying drawings.

Figure 1:
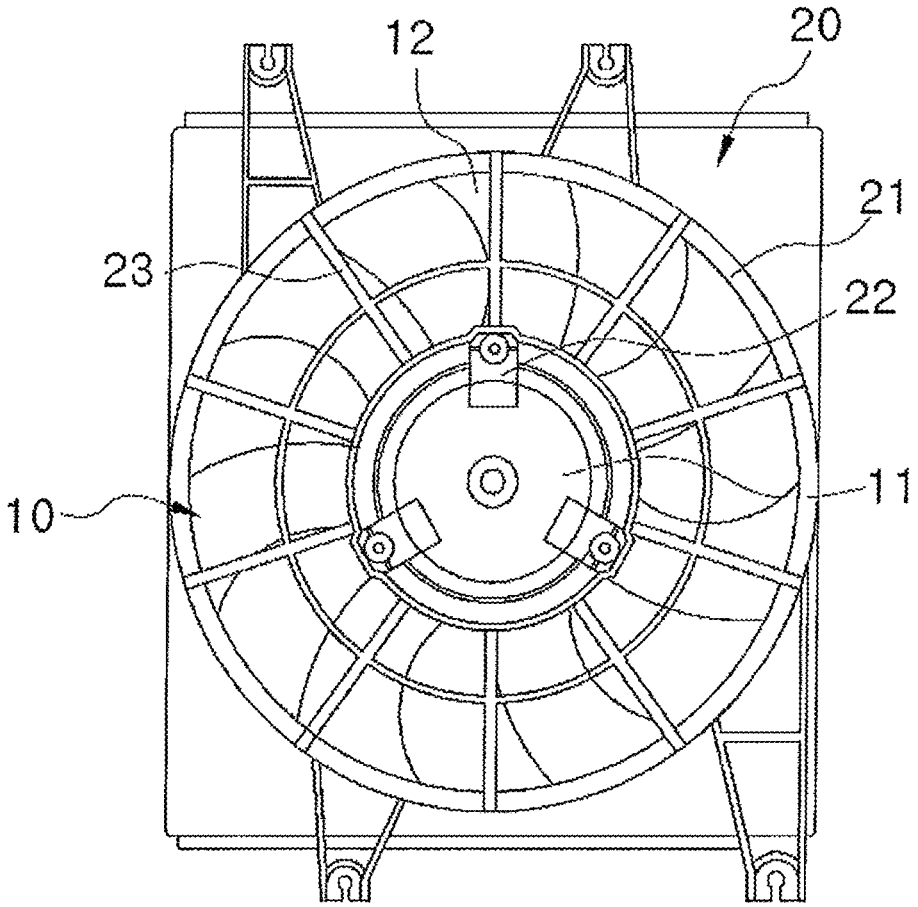
PRIOR ART FIG. 1
FIG. 1 is a front view illustrating a fan shroud assembly according to the related art.
Figure 2:
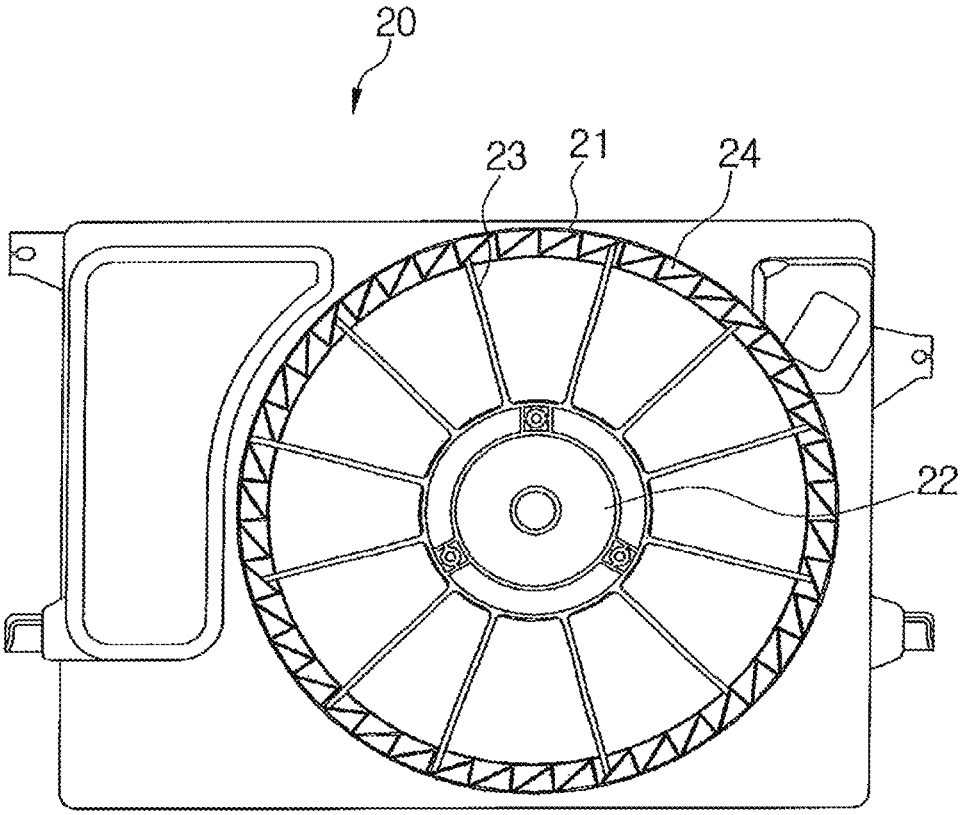
PRIOR ART FIG. 2
FIG. 2 is a front view illustrating another shroud according to the related art.
Figure 3:
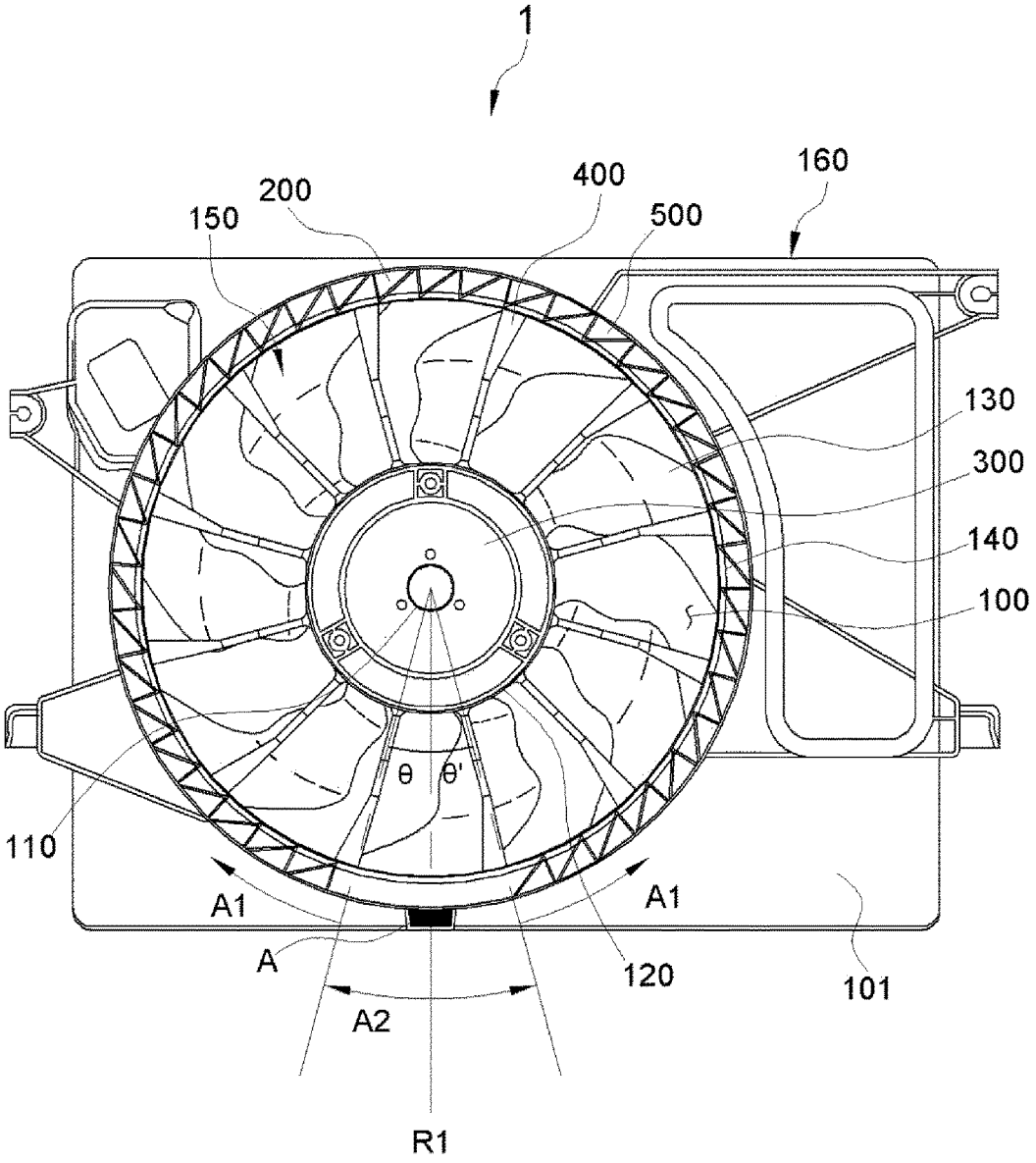
FIGS. 3 and 4 are front views illustrating a shroud according to an exemplary embodiment of the present invention.

As illustrated in FIG. 3, a fan shroud assembly 1 according to the exemplary embodiment of the present invention is largely configured to include a fan 150 and a shroud 160.

First, the fan 150 is a rotating fan transferring ventilating air to a heat exchanger of a vehicle while rotating by a motor 110 and is configured to include a hub 120, a blade 130, and a fan band 140. The shroud 160 is configured to include a bell mouth 200, a motor mounting 300, and a stator 400.

First, the bell mouth 200 forms a ventilating part 100 which is a space in which a predetermined area of a center of a plenum part 101 is hollow, such that air is ventilated through the ventilating part 100 by the fan 150.

The motor mounting 300 is a part in which a motor for driving the fan 150 is mounted and is positioned at a central area of the ventilating part 100.

The stator 400 is a member connecting between the motor mounting 300 and the bell mouth 200 at a front side of the fan of the vehicle and is configured to connect between an outer circumferential surface of the motor mounting 300 and an inner circumferential surface of the bell mouth 200 and is formed in plural along a circumference of the bell mouth 200 to control an inflow angle and a discharge angle of the ventilated air from the fan 150.

In particular, the shroud 160 is configured to further include a swirling airflow-preventing saw-teeth 500 which is arranged along a predetermined inner circumferential surface of the ventilating part 100 while maintaining a predetermined gap from an end portion of the blade 130 of the fan 150 or an end portion of the fan band 140 of the fan 150 and is formed in a saw-toothed shape, in which the swirling airflow-preventing saw-teeth 500 is formed only in some area and thus there is an area in which the swirling airflow-preventing saw-teeth 500 is not formed.

That is, when the area in which the swirling airflow-preventing saw-teeth 500 is formed is one, the shroud 160 has both ends spaced apart from each other in a circumferential direction and when the area in which the swirling airflow-preventing saw-teeth 500 is formed is in plural, both ends of the shroud 160 are configured to be spaced apart from end portions of adjacent areas in the circumferential direction.

For reference, the blade 130 is configured to be radially disposed in plural on a circumference of the hub 120 formed in a central portion of the fan 150 and transfer air in an axial direction.

Further, the fan band 140 is configured by connecting ends of the blade 130 to each other and is formed in a ring form on the whole.

That is, in the shroud 160, the swirling airflow-preventing saw-teeth 500 is not formed over the whole area along the inner circumferential surface of the ventilating part 100, but the swirling airflow-preventing saw-teeth 500 is formed within a predetermined angle based on a radius line R1 extending in the radial direction from the central portion of the ventilation part 100 and is formed only in the rest area.

When the swirling airflow-preventing saw-teeth 500 is formed in the whole area along the inner circumferential surface of the ventilation part 100, the problem that the fluctuation in flow pressure is rather increased in areas of the upper and lower ends of the bell mouth 200 which is a portion in which a space between the bell mouth 200 and an outer edge of the shroud 160 is narrow due to the saw-toothed shape is improved.

In this case, the radius line R1 means a vertical line to a tangent line of a point where a distance between the surface of the outer edge of the plenum part 101 and the bell mouth 200 is the shortest distance.

Therefore, the swirling airflow-preventing saw-teeth 500 is removed in some area of the fan shroud assembly 1 according to the present invention, such that the pressure fluctuation is reduced and thus the swirling airflow of the ventilated air occurs, thereby easily reducing noises.

In this case, when the area in which the swirling airflow-preventing saw-teeth 500 is formed is a first area A1 and the area in which the swirling airflow-preventing saw-teeth 500 is not formed and thus the inner circumferential surface of the ventilated part 100 is formed flatly is a second area A2. The fan shroud assembly 1 according to the present invention may be formed so that the second area A2 includes an area spaced as much as θ in one direction from the radius line R1 and an area spaced as much as θ' in the other direction therefrom.

In other words, as illustrated in FIG. 3, in the fan shroud assembly 1 according to the present invention, the swirling airflow-preventing saw-teeth 500 is not formed in the second area A2 within an angle of θ and θ' at both sides based on the radius line R1 and is formed in the first area A1.

In this case, the radius line R1 may coincide with the radius line extending in the vertical direction from the central portion of the ventilating part 100 and may be the state in which the radius line extending from the central portion of the ventilating part 100 in the vertical direction rotates by a predetermined angle.

The radius line R1 coincides with the radius line extending in the vertical direction when the plenum part 101 is formed in a rectangle or a square as illustrated in FIG. 3. When the plenum part 101 has a predetermined area of one side surface or both side surfaces stepped in a height direction as illustrated in FIG. 9, the radius line R1 is in the state in which the radius line extending in the vertical direction rotates by a predetermined angle.

Figure 8:
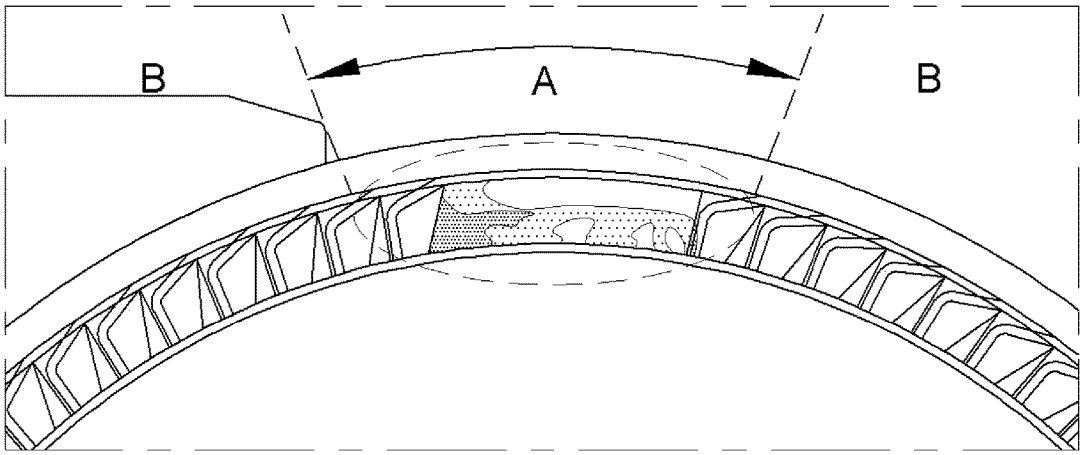

As illustrated in FIG. 8, the reason is that the fluctuation in air flow pressure is increased at the portion where the space between the bell mouth 200 and the outer edge of the plenum part 101 of the shroud 160 is narrow.

Figure 9:
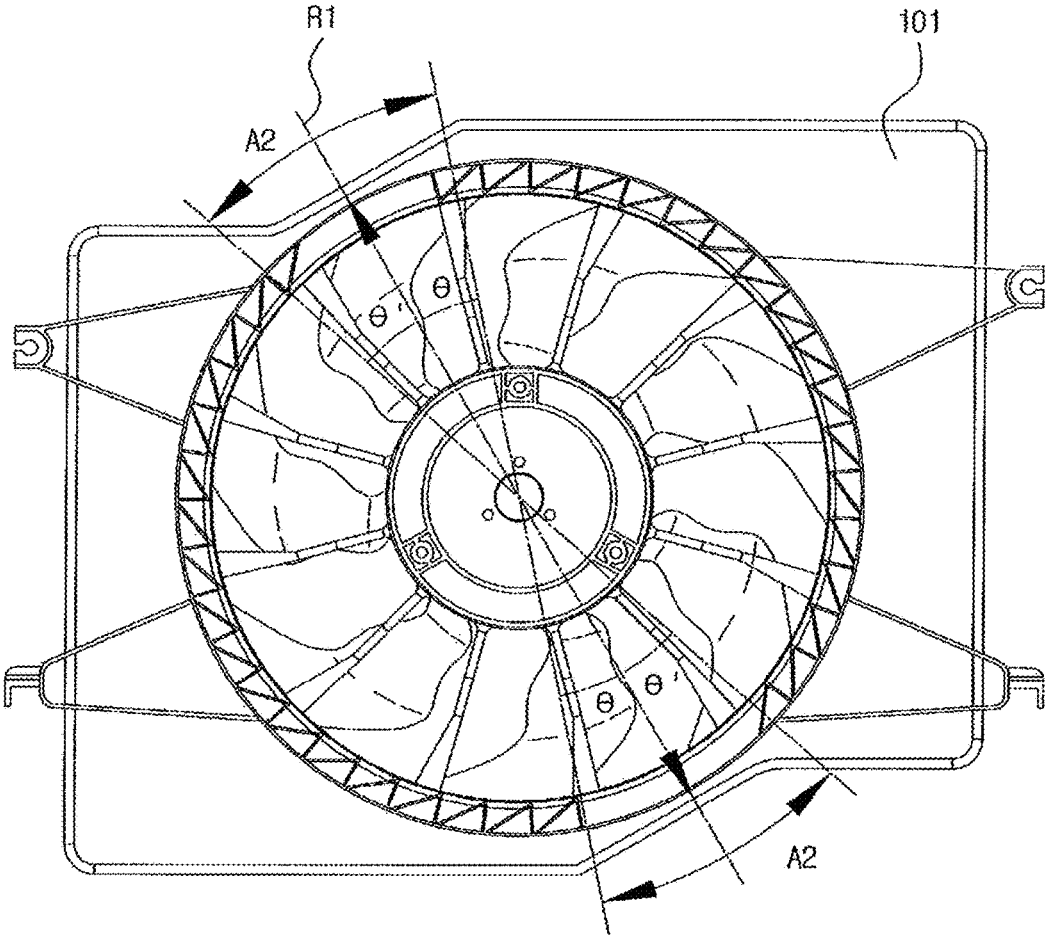
FIG. 9 is a diagram illustrating an example in which the shroud is not a rectangle, in the fan shroud assembly according to the exemplary embodiment of the present invention.
Figure 10:
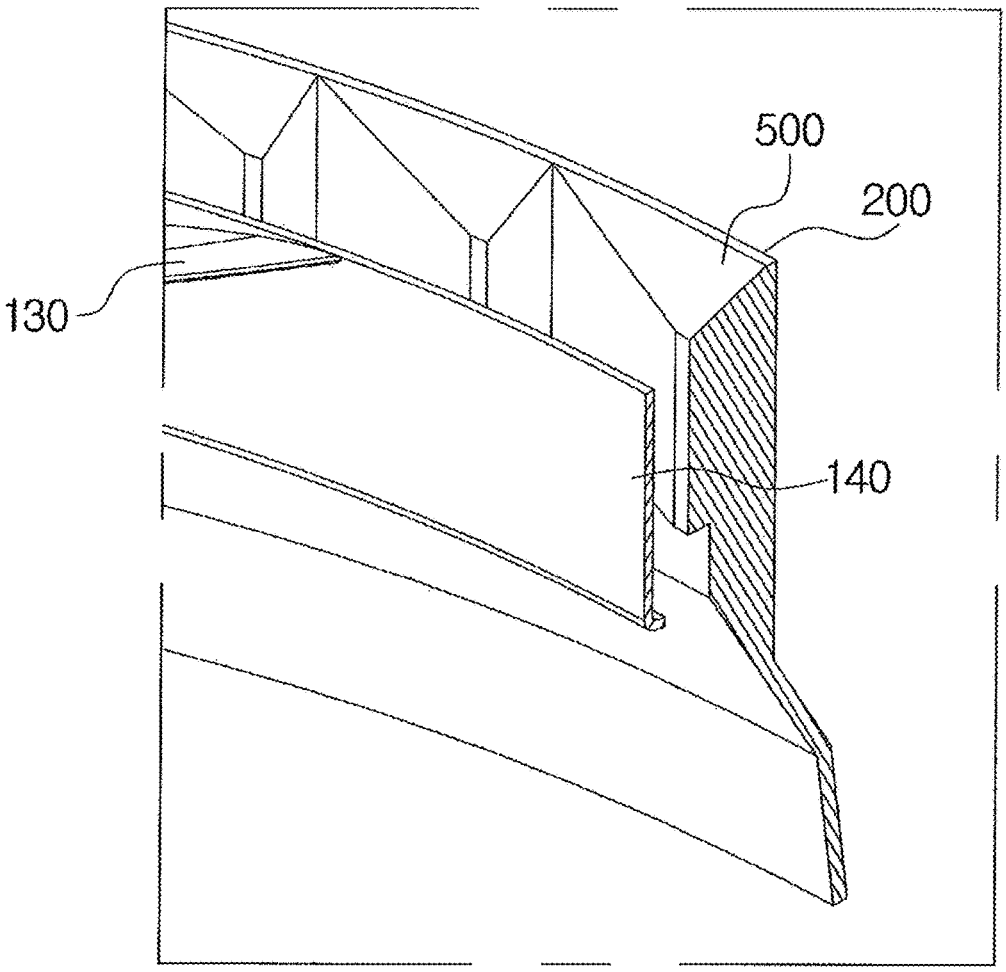
FIG. 10 is a cross-sectional view illustrating area A1 in the fan shroud assembly according to the exemplary embodiment of the present invention.
Figure 11:
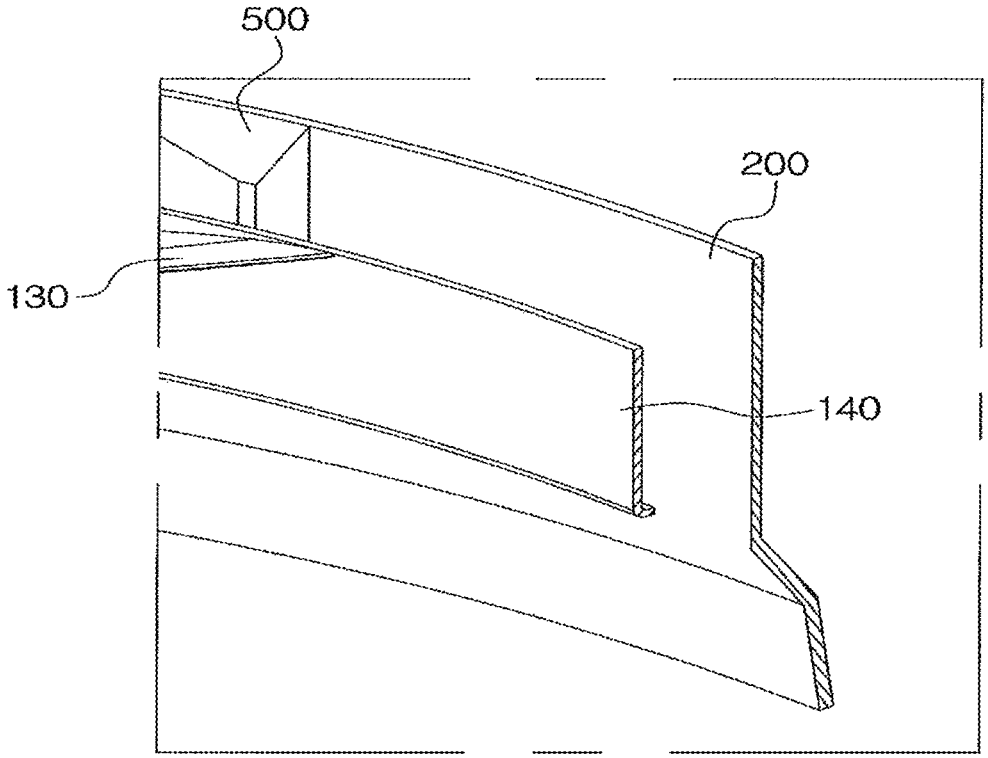
FIG. 11 is a cross-sectional view illustrating area A2 in the fan shroud assembly according to the exemplary embodiment of the present invention.

That is, in the fan shroud assembly 1 having the rectangular or squared plenum part 101, the area in which the pressure fluctuation is increased is both ends of the vertical radius line and in the fan shroud assembly having the stepped plenum part 101 as illustrated in FIG. 9, the area in which the fluctuation in pressure is increased is positioned at both ends of the area inclined by the predetermined angle from the vertical radius line.

Therefore, as described above, in the fan shroud assembly 1 of the present invention, to minimize the pressure fluctuation, the swirling airflow-preventing saw-teeth 500 is not formed at the portion where the space between the bell mouth 200 and the outer edge of the plenum part 101 is narrow.

In this case, in the fan shroud assembly 1 of the present invention, the second area A2 may be formed to be adjacent to both ends of the radius line R1 but may also be formed only in the upper or lower areas in a gravity direction.

Figure 7:
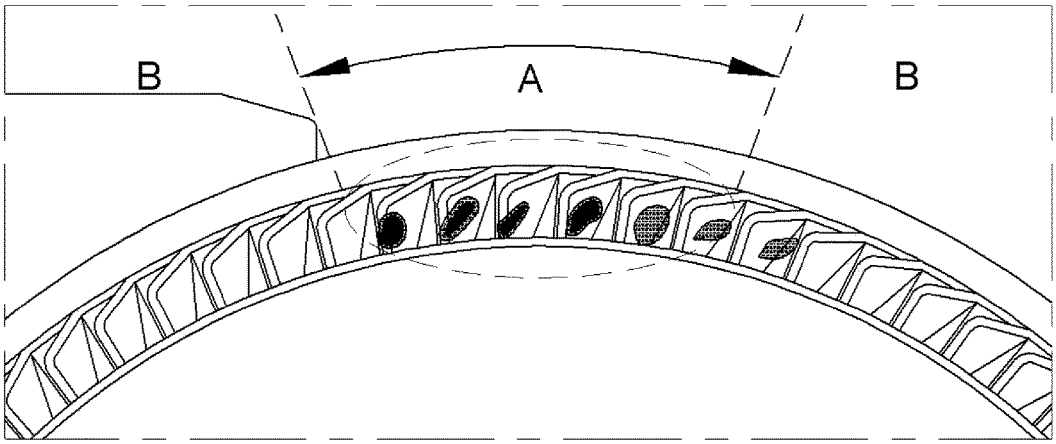
FIGS. 7 and 8 are analysis diagrams of flow characteristics before and after the swirling airflow-preventing saw-teeth is removed, in the area adjacent to the center of the radius line R1 in the shroud.

FIGS. 7 and 8 are analysis diagrams of flow characteristics before and after the swirling airflow-preventing saw-teeth 500 is removed, in the area adjacent to the vertical radius line R1 in the shroud 160.

As illustrated in FIG. 7, it may be appreciated that the fluctuation in the air flow pressure is increased at the portion where the space between the bell mouth 200 and the outer edge of the plenum part 101 of the shroud 160 is narrow.

On the other hand, when the swirling airflow-preventing saw-teeth 500 formed at the portion where the space between the bell mouth 200 and the outer edge of the plenum part 101 is narrow is removed, as illustrated in FIG. 8, it may be appreciated that the fluctuation in air flow pressure is reduced in the same area.

In this case, the portion where the space between the bell mouth 200 and the outer edge of the plenum part 101 is narrow is the area adjacent to the vertical radius line R1 of the ventilating part 100 and in the case of the plenum part 101 of the shroud 160 generally formed in the rectangle or the square due to the mounting space constraints in the vehicle, means the areas adjacent to the upper and lower ends of the ventilating part 100 which is a concentric circle.

As illustrated in FIG. 3, the swirling airflow-preventing saw-teeth 500 may be formed in a symmetric area to each other based on the radius line R1 of the ventilating part 100.

In other words, the distance spaced by the angle θ and the distance spaced by the angle θ' based on a point A of FIG. 3 as a center may have the same value.

Further, in the fan shroud assembly, the angles θ and θ' which are angles spaced apart from each other at both sides in the circumferential direction from the radius line R1 may be different from each other and may be variously changed.

In this case, the shroud 160 may have different noise reduction effects depending on the values of the angles θ and θ'. Accordingly, to find out the preferable values of the angles θ and θ', various experiment results are illustrated in FIGS. 5 and 6.

Figure 5A:
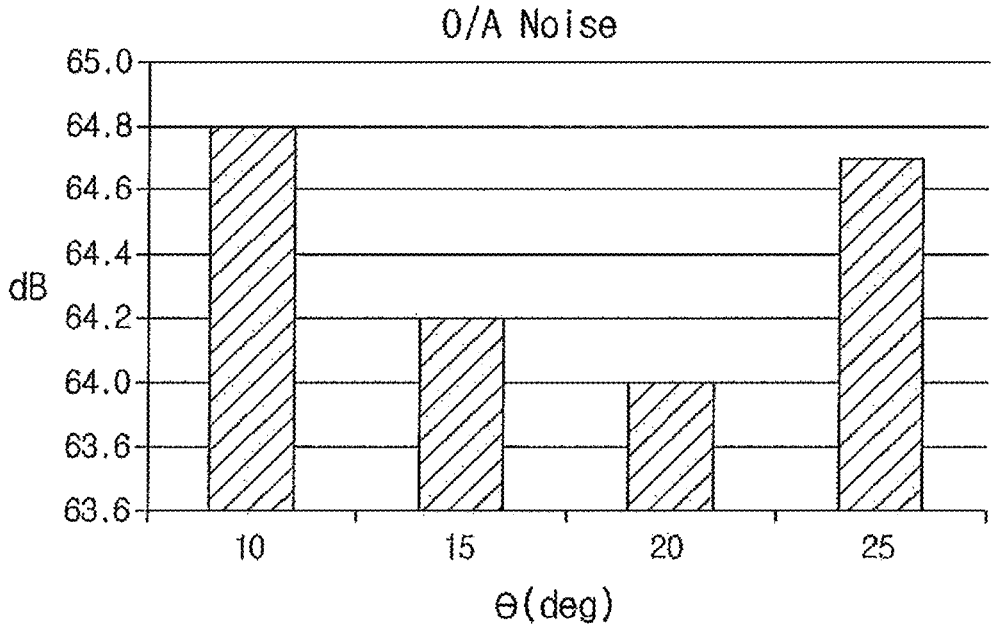
FIGS. 5A, 5B and 6 are comparison graphs of noises depending on an area in which a swirling airflow-preventing saw-teeth is removed, based on a radius line R1 in a shroud.
Figure 5B:
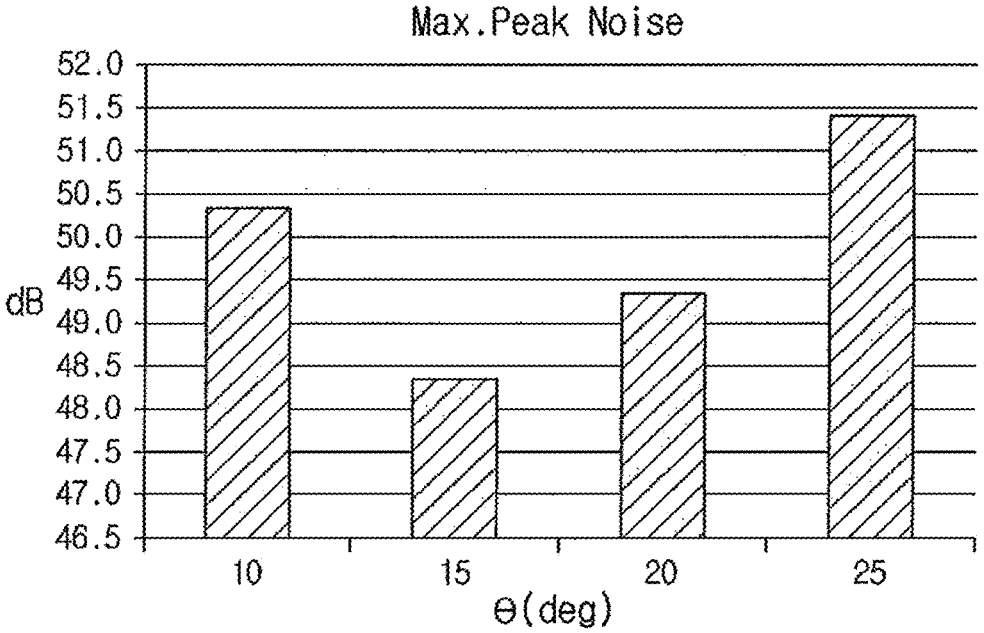

FIG. 5A illustrates noises measured by a noise measurement device at 1 m ahead of the blade 130 of the fan shroud assembly 1 while the value of the angle θ is changed at various angles and FIG. 5B illustrates max peak noise among the noise components of the fan shroud assembly 1.

Figure 6:
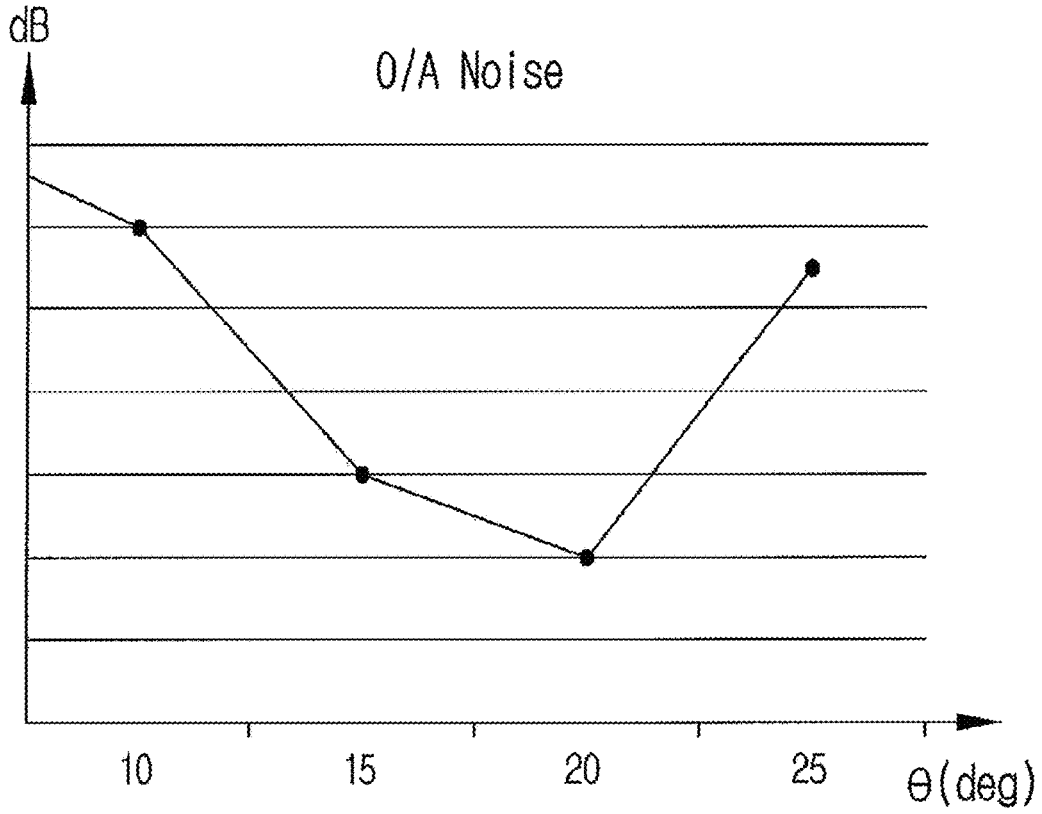

As illustrated in FIGS. 5 and 6, the noises of the fan shroud assembly are most reduced when the values of the angles θ and θ' are 15 to 20°.

Therefore, in the shroud 160, the swirling airflow-preventing saw-teeth 500 is preferably formed to be spaced from each other by 15 to 20° based on the radius line R1 of the ventilating part 100. As illustrated in FIG. 6, the reason is that the noise is increased due to the sudden increase in pressure in the second area A2 and if the values of the angles θ and θ' are smaller or larger than 15 to 20°, the noises are increased over a predetermined level and therefore the swirling airflow-preventing saw-teeth 500 is not preferably formed in the area in which the values of the angles θ and θ' are within 15 to 20°.

Further, in the shroud 160, the second area A2 which is the area in which is not provided with the swirling airflow-preventing saw-teeth 500 may be symmetrical with each other based on the horizontal radius line R2 of the ventilating part 100.

Meanwhile, the swirling airflow-preventing saw-teeth 500 includes a first surface of the rotating direction of the fan and a second surface of a direction opposite to the rotating direction of the fan 150 with respect to the radius line R1 of the ventilating part 100. The first surface or the second surface is formed to be inclined with respect to the radius line of the fan, and a mountain or a valley of the swirling airflow-preventing saw-teeth 500 may be formed in parallel with the axial direction of the fan.

Figure 4:
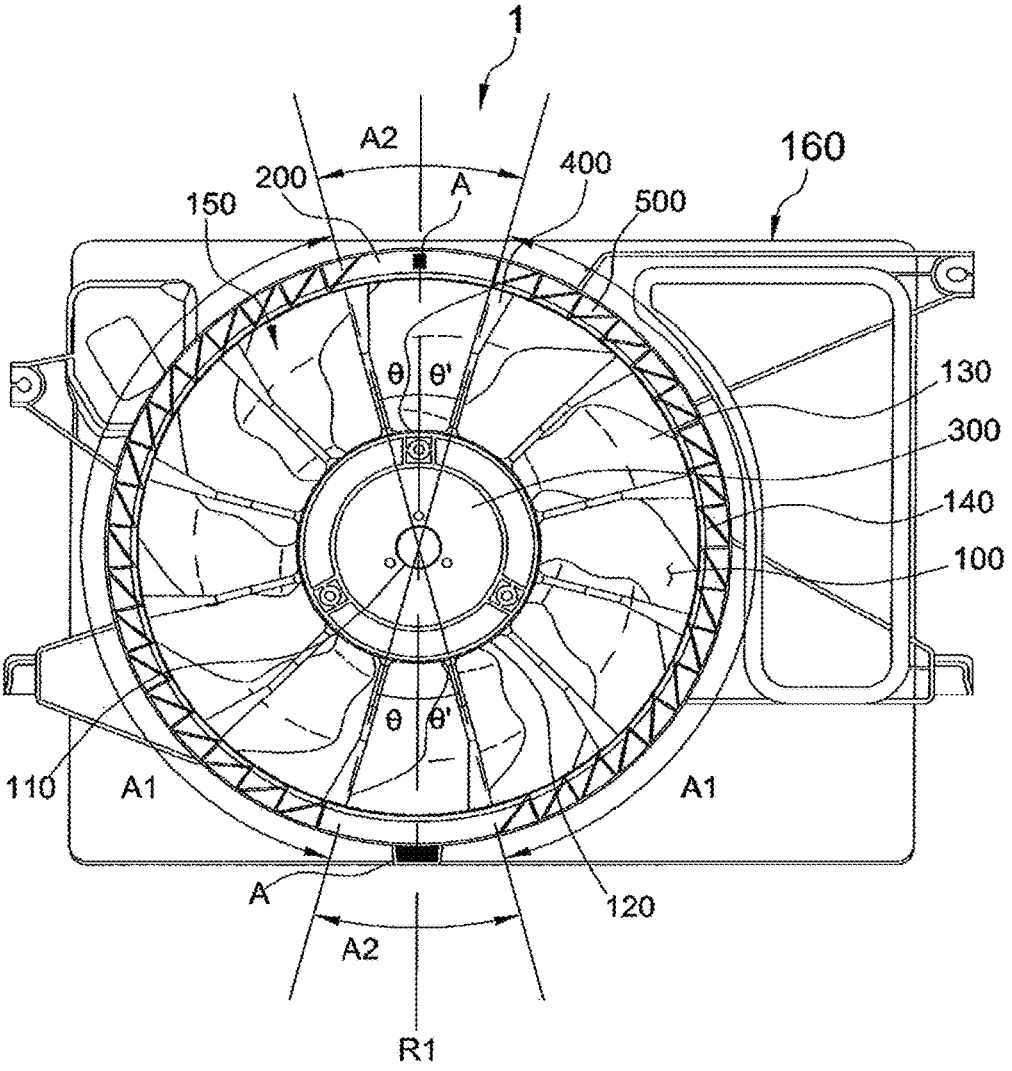

Describing an operation process of the fan shroud assembly 1 according to the present invention with reference to FIGS. 3 and 4, the fan 150 starts to rotate and then air may be ventilated from the front of the heat exchanger to the heat exchanger by a suction force depending on the rotation of the blade 130 of the fan 150 to cool the heat exchanger.

The air passing through the heat exchanger is guided to the ventilating part 100 of the shroud 160. The air guided to the ventilating part 100 is discharged to the back of the shroud 160 through the gap between the blades 130 by the bell mouth 200.

In this case, as by the rotation of the end of the blade 130, a low pressure is formed at the front which is a side in which air is sucked from the inner circumferential surface of the ventilating part 100 and a high pressure is formed at the back of a side to which air is discharged. The swirling airflow occurs from the back to the front and air reflows. However, in the fan shroud assembly 1 to which the shroud 160 is applied, the occurrence of the swirling airflow and the recirculating airflow is suppressed by the swirling airflow-preventing saw-teeth 500, thereby effectively reducing the noises.

Further, the great fluctuation in flow pressure does not occur even at the portion where the space between the bell mouth 200 and the outer edge of the shroud 160 is narrow, thereby more increasing the noise reduction effect than the case in which the swirling airflow-preventing saw-teeth 500 is formed on the whole inner circumferential surface of the ventilating part 100.

That is, the shroud 160 suppresses the swirling airflow and the recirculating airflow from occurring upon the air ventilation by the rotation of the fan 150 through the swirling airflow-preventing saw-teeth 500 to reduce the noise. The swirling airflow-preventing saw-teeth 500 is formed only in some area to prevent the problem that the fluctuation in flow pressure is rather increased by the swirling airflow-preventing saw-teeth 500 positioned at the portion where the space between the bell mouth 200 and the outer edge of the shroud 160 is narrow, thereby more increasing the noise reduction effect than the case in which the swirling airflow-preventing saw-teeth 500 is formed along the whole inner circumferential surface of the ventilating part 100.

Further, the fan shroud assembly 1 of the present invention may prevent moisture from being easily collected and being frozen in a depressed portion formed between the swirling airflow-preventing saw-teeth 500 of the bell mouth 200 positioned at the bottom portion in the gravity direction of the shroud 160.

That is, the present invention forms the second area A2 in which the swirling airflow-preventing saw-teeth 500 is not formed at the bottom portion in the gravity direction of the shroud 160 to prevent moisture from being collected and being frozen, thereby preventing the fan 150 from being stuck due to the frozen moisture.

According to the exemplary embodiments of the present invention, the fan shroud assembly 1 may include the swirling airflow-preventing saw-teeth 500 which is arranged along the predetermined inner circumferential surface of the ventilating part 100 while maintaining a predetermined gap from the end portion of the blade 130 of the fan 150 or the end portion of the fan band 140 of the fan 150 and is formed in the saw-toothed shape, in which both the first area in which the swirling airflow-preventing saw-teeth 500 is formed and the second area A2 from which the swirling airflow-preventing saw-teeth 500 is removed are formed, thereby generating the swirling airflow of ventilated air due to the reduction in pressure fluctuation and thus effectively reducing noise.

In other words, according to the exemplary embodiments of the present invention, the swirling airflow-preventing saw-teeth 500 may suppress the swirling airflow and the recirculating airflow from occurring when air is ventilated by the rotation of the fan 150 to reduce noises and the swirling airflow-preventing saw-teeth 500 is formed only in some area to prevent the fluctuation in flow pressure from rather increasing due to the swirling airflow-preventing saw-teeth 500 positioned at the portion where the space between the bell mouth 200 and the outer edge of the shroud 160 is narrow, that is, at the area adjacent to the radius line in the vertical direction of the ventilating part 100, thereby more increasing the noise reduction effect than the case in which the swirling airflow-preventing saw-teeth 500 is formed along the whole of the inner circumferential surface of the ventilating part 100.

Further, according to the exemplary embodiments of the present invention, the fan shroud assembly 1 may prevent moisture from being easily collected between the bell mouth 200 and the fan band 140 when the swirling airflow-preventing saw-teeth 500 is not formed in the bell mouth 200 positioned at the bottom portion in the gravity direction of the shroud 160, thereby preventing the fan 150 from being stuck or frozen due to the freezing of the moisture.

The present invention is not limited to the above-mentioned exemplary embodiments but may be variously applied, and may be variously modified by those skilled in the art to which the present invention pertains without departing from the gist of the present invention claimed in the claims.

What is claimed is:

1. A fan shroud assembly comprising:

a fan including a hub coupled to a rotating shaft of a motor, a plurality of blades formed on an outer circumferential surface of the hub, and a fan band connecting the plurality of blades to each other at an end portion of the plurality of blades;

a shroud including a plenum part, a bell mouth forming a ventilating part in the plenum part, a motor mounting disposed at a central area of the ventilating part and configured to fixedly mount the motor to the fan shroud assembly, and a plurality of stators connecting and extending between the motor mounting and the bell mouth, the ventilating part receiving ventilated air generated by a rotation of the fan; and a plurality of saw-teeth formed along an inner circumferential surface of the ventilating part to maintain a gap formed between the fan band and the bell mouth, the plurality of saw-teeth having a saw-toothed shape, a first end of the plurality of saw-teeth is spaced apart from a second end of the plurality of saw teeth in a circumferential direction, wherein the plurality of saw-teeth is entirely formed in a first area of the fan shroud assembly, and wherein a second area of the fan shroud assembly extends in a first direction from a radius line at a first angle and in a second direction from the radius line at a second angle, the radius line extending in a radial direction from a central portion of the ventilating part to an outer edge surface of the plenum part, wherein each of the first angle and the second angle is an acute angle, and wherein the first angle is different from the second angle.

2. The fan shroud assembly of claim 1, wherein a planar portion of the inner circumferential surface of the ventilating part is formed in the second area of the fan shroud assembly, the second area separate from the first area.

3. The fan shroud assembly of claim 1, wherein a distance between an outer edge surface of the plenum part and the bell mouth is minimized in the second area of the fan shroud assembly, the second area separate from the first area.

4. The fan shroud assembly of claim 1, wherein each of the first angle and the second angle is in a range from 15 degrees to 20 degrees.

5. The fan shroud assembly of claim 1, wherein the radius line extends through a portion of the plenum part where a distance between an outer edge surface of the plenum part and the bell mouth is minimized.

6. The fan shroud assembly of claim 5, wherein the second area is positioned at a lower part of the fan shroud assembly with respect to a gravity direction.

7. A fan shroud assembly comprising:

a fan including a hub coupled to a rotating shaft of a motor, a plurality of blades formed on an outer circumferential surface of the hub, and a fan band connecting the plurality of blades to each other at an end portion of the plurality of blades;

a shroud including a plenum part, a bell mouth forming a ventilating part in the plenum part, a motor mounting disposed at a central area of the ventilating part and configured to fixedly mount the motor to the fan shroud assembly, and a plurality of stators connecting and extending between the motor mounting and the bell mouth, the ventilating part receiving ventilated air generated by a rotation of the fan; and a plurality of saw-teeth formed along an inner circumferential surface of the ventilating part to maintain a gap formed between the fan band and the bell mouth, the plurality of saw-teeth having a saw-toothed shape, a first end of the plurality of saw-teeth is spaced apart from a second end of the plurality of saw teeth in a circumferential direction, wherein the plurality of saw-teeth is entirely formed in a first area of the fan shroud assembly, wherein a second area of the fan shroud assembly extends in a first direction from a radius line at a first angle and in a second direction from the radius line at a second angle, the radius line extending in a radial direction from a central portion of the ventilating part to an outer edge surface of the plenum part, wherein the radius line extends through a portion of the plenum part where a distance between an outer edge surface of the plenum part and the bell mouth is minimized, and wherein the second area is positioned at a lower part of the fan shroud assembly with respect to a gravity direction.

8. The fan shroud assembly of claim 7, wherein a planar portion of the inner circumferential surface of the ventilating part is formed in the second area of the fan shroud assembly, the second area separate from the first area.

9. The fan shroud assembly of claim 7, wherein a distance between an outer edge surface of the plenum part and the bell mouth is minimized in the second area of the fan shroud assembly, the second area separate from the first area.

10. The fan shroud assembly of claim 7, wherein each of the first angle and the second angle is in a range from 15 degrees to 20 degrees.

11. The fan shroud assembly of claim 7, wherein each of the first angle and the second angle is an acute angle.

12. The fan shroud assembly of claim 11, wherein the first angle is equal to the second angle.

13. The fan shroud assembly of claim 11, wherein the first angle is different from the second angle.

* * * * *